US010315099B2

(12) United States Patent
Shute et al.

(10) Patent No.: US 10,315,099 B2
(45) Date of Patent: Jun. 11, 2019

(54) LIGHTWEIGHT TOURING BINDING HEEL UNIT

(71) Applicant: G3 GENUINE GUIDE GEAR INC., Burnaby, BC (CA)

(72) Inventors: Cameron Shute, Nelson (CA); Simon Padraic Hammond, Vancouver (CA)

(73) Assignee: G3 GENUINE GUIDE GEAR INC., Burnaby, British Columbia (CA)

( * ) Notice: Subject to any disclaimer, the term of this patent is extended or adjusted under 35 U.S.C. 154(b) by 0 days.

(21) Appl. No.: 15/798,602

(22) Filed: Oct. 31, 2017

(65) Prior Publication Data

US 2019/0126131 A1 May 2, 2019

(51) Int. Cl.
*A63C 9/084* (2012.01)

(52) U.S. Cl.
CPC ..... *A63C 9/0846* (2013.01)

(58) Field of Classification Search
CPC ..... A63C 10/14; A63C 10/28; A63C 10/285; A63C 9/10; A63C 9/0846
See application file for complete search history.

(56) References Cited

U.S. PATENT DOCUMENTS 8,439,389 B2 * 5/2013 Moore ..... A63C 7/12 280/11.33
8,746,728 B2 * 6/2014 Shute ..... A63C 7/1013 280/607

(Continued)

FOREIGN PATENT DOCUMENTS

AT 402020 B 6/1997
DE 102011078834 A1 1/2013

(Continued)

OTHER PUBLICATIONS

Engstle, Jörg, Office Action for German Patent Application No. 102018003950.2 dated Jan. 18, 2019 (20 pages).

*Primary Examiner* — James A Shriver, II
*Assistant Examiner* — James J Triggs

(57) ABSTRACT

A heel unit apparatus for a ski touring binding is disclosed which comprises a body mounted on a support, the body being rotatable relative to the support on a vertical axis. The body comprises a resilient element movable within the body which when pre-loaded under compression or tension, exerts forces in opposing directions. The body also comprises at least one forward connector moveable between resting and release positions for releasably connecting the body to the heel of a footwear and a My linkage between the resilient element and the at least one forward connector configured such that force exerted in one of the opposing directions resists movement of the at least one forward connector from the resting position to the release position. The resilient element, the at least one forward connector and the My linkage cooperate to resist forward release. The body further comprises a Mz linkage between the resilient element and a resting surface on the support configured such that the force in the other of the opposing directions presses against the resting surface to resist rotation of the body about the support. The resilient element, the Mz linkage and the body cooperate to resist lateral release. Shocks independently affecting the My and the Mz linkages do not significantly lessen resistance to Mz and My release, respectively.

20 Claims, 13 Drawing Sheets

(56) References Cited

U.S. PATENT DOCUMENTS

| | | | | |
|---|---|---|---|---|
| 9,149,710 | B2 | 10/2015 | Moore et al. | |
| 9,242,167 | B2 | 1/2016 | Shute et al. | |
| 9,597,578 | B2 | 3/2017 | Moore et al. | |
| 2011/0025003 | A1* | 2/2011 | Moore | A63C 7/12 280/11.33 |
| 2016/0089592 | A1* | 3/2016 | Damiani | A63C 10/08 280/611 |

FOREIGN PATENT DOCUMENTS

| | | | |
|---|---|---|---|
| DE | 102013224576 | A1 | 6/2015 |
| EP | 0199098 | A2 | 10/1986 |
| EP | 0519243 | A1 | 12/1992 |
| EP | 1559457 | A1 | 8/2005 |
| EP | 2384794 | A1 | 11/2011 |
| EP | 3305379 | A1 | 4/2018 |
| WO | 2009105866 | A1 | 9/2009 |
| WO | 2009121187 | A1 | 10/2009 |

* cited by examiner

LIGHTWEIGHT TOURING BINDING HEEL UNIT

FIELD

The invention relates to release bindings used in ski touring.

BACKGROUND

Alpine ski touring bindings allow the heel of the user's footwear to be latched to a ski or other snow travel aid for sliding downhill (the "downhill mode") and allow the heel to be released for walking and climbing (the "touring mode"). Thus, the binding allows for selective holding of the footwear heel to the snow travel aid so that the user may select between the downhill mode and the touring mode. Modern alpine ski touring bindings allow the footwear to release from the snow travel aid when in the downhill mode, in case of a fall. When in the touring mode, the user may climb or walk with a great degree of freedom since the footwear is pivotally engaged with the aid near the toe of the footwear while the heel of the footwear is free to move upward and downward relative to the aid. A historical collection of such bindings can be viewed in the "Virtual Museum of Backcountry Skiing Bindings" at www.wild-snow.com, authored by Louis Dawson.

Alpine ski touring bindings of the type that originated under the brand DYNAFIT are bindings that take advantage of the fact that modern alpine touring footwear has a rigid sole. Thus, it is unnecessary to provide a bar, plate or other arrangement connecting toe and heel units, as is the case with many other alpine touring bindings. This type of binding is referred to herein as a "Tech-type" binding. Examples of such bindings are disclosed in patent publications AT 402020, EP0199098, EP0519243, EP1559457, WO2009/105866, WO2009/121187, and US2015/0014963.

Tech-type binding systems comprise toe and heel units that function independently to retain the footwear toe and heel respectively on a snow travel aid. The toe unit typically comprises a set of jaws that pivotally engage inserts placed in the footwear toe region during manufacture of the footwear. The toe unit is mounted at an appropriate location on the upper surface of the snow travel aid. The heel unit is mounted rearward of the toe unit at a location typically indicated by the length of the footwear sole.

The heel unit of a Tech-type binding comprises one or more forward connectors (typically a pair of pins) which extend forward to engage a fitting typically placed in the heel of the footwear during manufacture of the footwear. Under forward (My) release conditions during a fall, the pins are forced apart against a resistant, lateral force which allows the pins to disengage from the fitting in the footwear heel. The pins typically communicate with one or more My springs through components that include a sliding wedge arrangement, one or more cams or other suitable means for translating forwardly directed pressure exerted by the My spring(s) into a lateral force that resists the pins moving apart from each other. Forward release values are adjusted by adjusting pre-load compression on the My spring. In the heel unit disclosed in DE102011078834, the ends of a "U"-shaped bracket serve as pins for connecting to a Tech-type fitting in the footwear heel while the web of the bracket provides the lateral force that resists separation of the pins. This eliminates the need for a separate My spring but does not provide for readily adjustable forward release values.

The heel unit of a Tech-type type binding also provides for lateral (Mz) release in the case of a fall and can further allow for transition between downhill and touring modes as a result of the body of the heel unit being pivotally engaged on a support. Variable lateral release values are provided by adjusting the pre-load compression of an Mz spring that is separate from the My spring and which presses a plunger or other bearing element against a flat or hollow region on a surface of a support on which the body rotates. By providing a plurality of such regions around the perimeter of the support, the body of the heel unit will tend to rest at different rotational positions corresponding to each flat or hollow region on the support, which facilitates retention of the heel unit in either the downhill or touring mode. To switch between touring and downhill modes with such a system, the heel unit is rotated so that the forward connector(s) are positioned to engage the footwear heel (downhill mode) or so that the connector(s) face away from the heel (touring mode). When the forward connector(s) face away, the footwear heel is free to move upward and downward to facilitate walking and climbing with the toe of the footwear pivotally retained on the snow travel aid by means of the toe unit. Some Tech-type heel units rotate to facilitate lateral release but not for transition between downhill and touring modes. For example, embodiments disclosed in WO2009/105866 rotate for lateral release and translate longitudinally to transition between downhill and touring modes.

A touring binding heel unit that provides a single point of adjustment for forward and lateral release is disclosed in EP0519243. That heel unit does not use the forward connectors of a binding heel unit that disengages from a Tech-type fitting in the heel of the footwear through movement of forward connectors themselves. Instead, the parts of the heel unit in EP0519243 that engage with the heel are fixed relative to the heel unit and disengagement from the heel results from vertical and rearward displacement of those elements caused by rotational movement of the entire body of the heel unit about a horizontal axis perpendicular to the direction of travel. The body also rotates on a vertical axis to provide lateral release and transition between downhill and touring modes. A single spring applies pressing force through a member that presses against a complex series of recesses formed about a spherical support member. The design of this binding is not conducive to providing a lightweight variant of a Tech-type heel unit nor is it intended to cooperate with footwear that has been manufactured to contain typical Tech-type fittings in the heel.

Both simplicity and minimizing weight are desirable characteristics of a touring binding. The heel unit disclosed in EP2384794 is based on a traditional Tech-type binding with pins that engage Tech-type fittings in the heel of the footwear and which separate against a resistant force provided by a My spring for forward release. Rather than including a separate Mz spring and associated components for transmitting force against the support on which the body of the heel unit rotates, a My spring under compression and fixed at its rearward end provides the force to resist both forward release as well as to resist rotation of the body. Adjustment of pre-load compression on the single spring adjusts Mz and My release values simultaneously. This is made possible by transferring pressure from the forward end of the My spring directly through a vertically arranged follower that presses against a cam surface within a depression located at the rear of the rotational support for the body of the heel unit as well as to the pins that engage the fitting in the heel of the footwear. Lateral forces exerted on this heel unit when in the downhill mode result in the body rotating against resistant force as usual. However, since the Mz components are also coupled to the My spring, such movement simultaneously relieves the resistant force exerted on the pins through the My components. This is not desirable if the device were to be adjusted or configured such that lateral shocks insufficient to cause lateral release would nevertheless allow the footwear to disengage from the heel unit in a forward direction without resistance.

SUMMARY OF THE INVENTION

Disclosed herein is a heel unit apparatus for a ski touring binding, the apparatus comprising a body mounted on a support. The body is rotatable relative to the support on a vertical axis. The body comprises a resilient element movable within the body which when pre-loaded under compression or tension, exerts forces in opposing directions. The body also comprises at least one forward connector moveable between resting and release positions for releasably connecting the body to the heel of a footwear and a My linkage between the resilient element and the at least one forward connector configured such that force exerted in one of the opposing directions is transferred to resist movement of the at least one forward connector from the resting position to the release position. The at least one forward connector may be a single connector or a pair of connectors. The resilient element, the at least one forward connector and the My linkage cooperate to provide for My release. The body further comprises a Mz linkage between the resilient element and a resting surface on the support configured such that the force in the other of the opposing directions is transferred so as to press against the resting surface to resist rotation of the body about the support. The resilient element, the Mz linkage and the body cooperate to provide for Mz release.

In any of the aforementioned embodiments, the My and Mz linkages may be independently configured to push, pull or include a pulling action. In particular embodiments, the My linkage is configured to push and the Mz linkage is configured to convert a pushing force into a pulling force. A linkage for pulling may comprise a flexible connector such as a cable or a relatively inflexible connector such as a bracket.

In any of the aforementioned embodiments, the My and Mz linkages may be acted upon at opposing points on the resilient element, such as at opposing ends or sides of the resilient element. The forces exerted by the resilient element may be directed both forwardly and rearwardly. In particular embodiments, the My linkage is acted upon by a forward end of the resilient element and the Mz linkage is acted upon by a rearward end of the resilient element.

In any of the aforementioned embodiments, movement of members of a pair of forward connectors between resting and release positions may be a convergence or separation and/or movement of the at least one forward connector may comprise a transverse movement. In particular embodiments, the My linkage changes direction of the force exerted through it from a longitudinal to a transverse direction.

In any of the aforementioned embodiments, the at least one forward connector is a pair of pins. The My linkage may apply the force to press against the pins.

In any of the aforementioned embodiments, the resilient element may be under tension or compression. The resilient element may be a spring or spring set, the opposing ends of which act on the My and Mz linkages, respectively. The resilient element may be a compressionable or tensionable object such as a rod, block or sphere made of an elastomeric material.

In any of the aforementioned embodiments, the support may comprise a tower about which the body rotates. The tower may be shaped at one or more locations about its perimeter to provide one or more resting surfaces on which the Mz linkage bears during rotation of the body. The Mz linkage may extend across the tower and parallel to a diameter of the tower. The Mz linkage may comprise a bracket. The Mz linkage may be acted upon by a rearward end of the resilient element. The Mz linkage may comprise a bracket having a rearward facing bearing surface at a forward end thereof which bears on the tower perimeter during rotation of the body with the bracket extending rearward to a rearward end of the resilient element.

The amount of resistance to movement of the at least one forward connector from the resting position to the release position and the amount of resistance to rotation of the body about the support can be simultaneously altered by changing the amount of force exerted by the resilient element which is pre-loaded with tension or compression. Thus, the apparatus may further comprise an adjustor for changing that amount of force. In particular embodiments, the resilient element is a spring or spring set under compression and the apparatus further comprises an adjustor for altering the amount of compression on the spring or spring set. The adjustor may be part of the Mz linkage.

Any of the aforementioned embodiments may further comprise a base mountable to a snow travel aid for holding the support. The base and support may be configured for slidable engagement and may further comprise an adjustor for positioning the support along a longitudinal direction on the base.

Any of the aforementioned embodiment may further comprise a snow brake. In particular embodiments, the snow brake is engaged with a base mountable to a snow travel aid which also holds the support.

BRIEF DESCRIPTION OF THE DRAWINGS

In the drawings, an arrow labelled with the symbol "R" indicates the rearward direction.

DETAILED DESCRIPTION OF PARTICULAR EMBODIMENTS

Figure 1A:
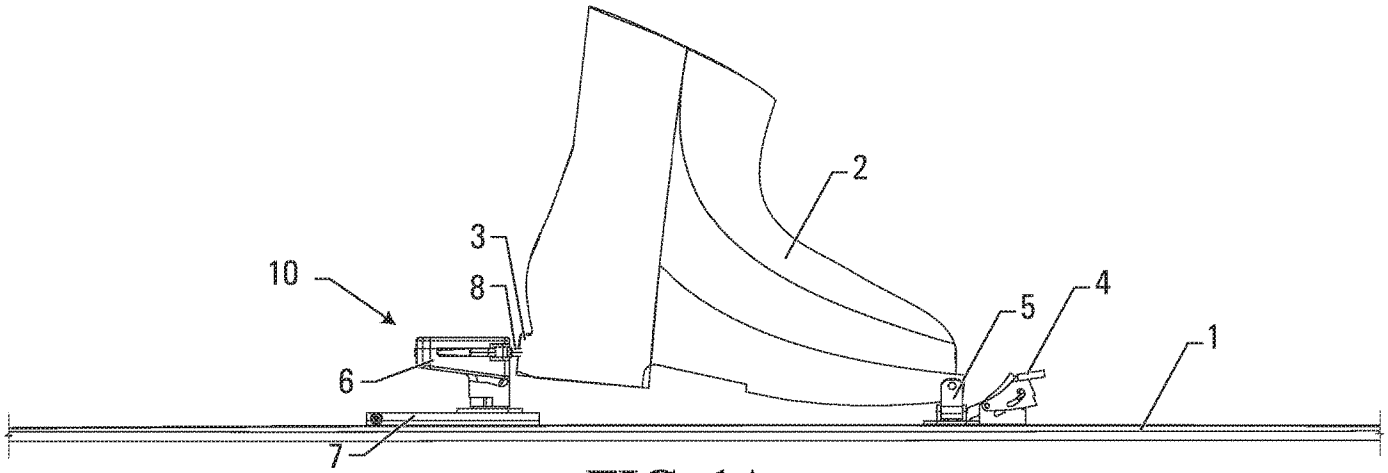
FIG. 1A Prior Art
FIGS. 1A and 1B are side and plan views, respectively of a ski, ski boot and a prior art ski touring binding.

Snow travel aids as contemplated herein are devices that support a user and are adapted to slide on a snow surface. Examples include skis, other snow sliding devices shaped like a ski and snowboards. This includes devices known as "split-boards" (which are snowboards that can be separated longitudinally into at least two portions, the two portions then functioning in a manner similar to a pair of skis). Examples of such other devices include "ski blades", "snow blades", "ski boards", and "sliding" or "gliding snow shoes".

In this specification, reference to "Mz" refers to the lateral release characteristic that involves torque applied about an axis that is perpendicular to the upper surface of a snow travel aid. The term "My" refers to the forward release characteristic whereby torque is applied about an axis that is parallel to the upper surface and perpendicular to the longitudinal axis of the snow travel aid.

In this specification, reference to "resilient element" refers to an element that when pre-loaded by a force of compression or tension, the element exerts a force against adjacent objects or objects to which the resilient element is coupled that is opposite in direction to the pre-load force. Thus, a resilient element may be elastic or compressible and in either case, may comprise a spring or spring set.

The term "spring set" means a group of two or more springs which collectively provide a force directed to the same object. For example, a plurality of springs may be coaxially arranged or placed in an adjacent arrangement between common bases, bearing surfaces or couplings.

In this specification, reference to "vertical" is intended to indicate a direction upwards or downwards from a reference line or place but does not require absolute perpendicularity to such reference. Conversely, the term "horizontal" is not limited to a direction or plane that is absolutely parallel to a transverse reference line or surface or absolutely perpendicular to a vertical reference line or surface. The term "parallel" includes lines or planes that are exactly parallel to a reference line or plane as well as those which form an angle of less than 45 degrees with the reference. The term "perpendicular" is not limited to a 90 degree orientation but includes orientations that form an angle to a reference of greater than 45 degrees and less than 135 degrees. In the context of the present invention, the terms in this paragraph are employed by reference to the upper surface of a snow travel aid, unless the context dictates otherwise.

Unless the context dictates otherwise, the terms "longitudinal" and "transverse" generally relate to direction of travel of a snow travel aid and include orientations that are precisely parallel or perpendicular to the longitudinal axis or direction of travel of the snow travel aid, respectively. The terms "longitudinal" and "transverse" also include orientations that are at an angle that is less than 45 degrees or greater than 45 degrees from the longitudinal axis or direction of travel of a snow travel aid, respectively. Likewise, the terms "forward" and "rear" or "rearward" relate to forward and rearward directions of travel of a snow travel aid and include orientations or directions which form an angle of less than 45 degrees to the longitudinal axis or direction of travel of the snow travel aid. Thus, with regard to a ski binding heel unit in downhill mode, the term "forward" refers to a direction towards the footwear heel with which the heel unit engages. Likewise, the term "sideward" relates to a direction that is perpendicular to the longitudinal axis or direction of travel of a snow travel aid and includes directions that form an angle to the longitudinal axis or direction of travel of the snow travel aid that is greater than 45 degrees.

Figure 1B:
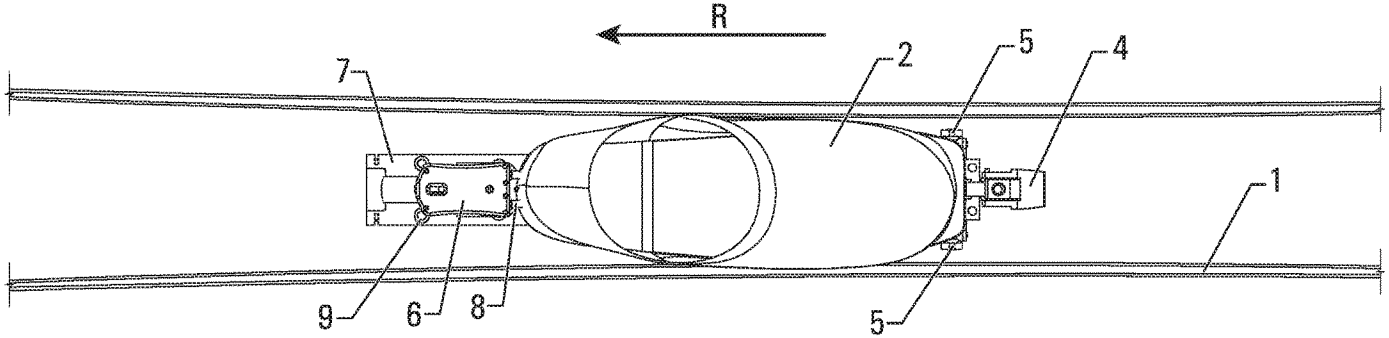
FIG. 1B Prior Art

FIGS. 1A and 1B show a prior art Tech-type binding system, including toe unit 4 and heel unit 10 mounted on the upper surface of ski 1. The toe unit comprises jaws 5 that pivotally engage with special fittings (not shown) embedded in the toe of ski boot 2. Dual pins 8 on heel unit 10 engage the rear portion of the boot heel 3. The heel unit comprises a base plate 7 fixed to the ski surface by multiple fasteners 9. Body 6 of the heel unit contains forward connectors, which are illustrated as a pair of pins 8. The arrangement shown in FIGS. 1A and 1B is the downhill mode with both the toe and heel of the boot engaged by the binding system. It should be noted that pins 8 are visible in the downhill mode in a gap between boot heel 3 and a forward side of upper portion 6.

Figure 2A:
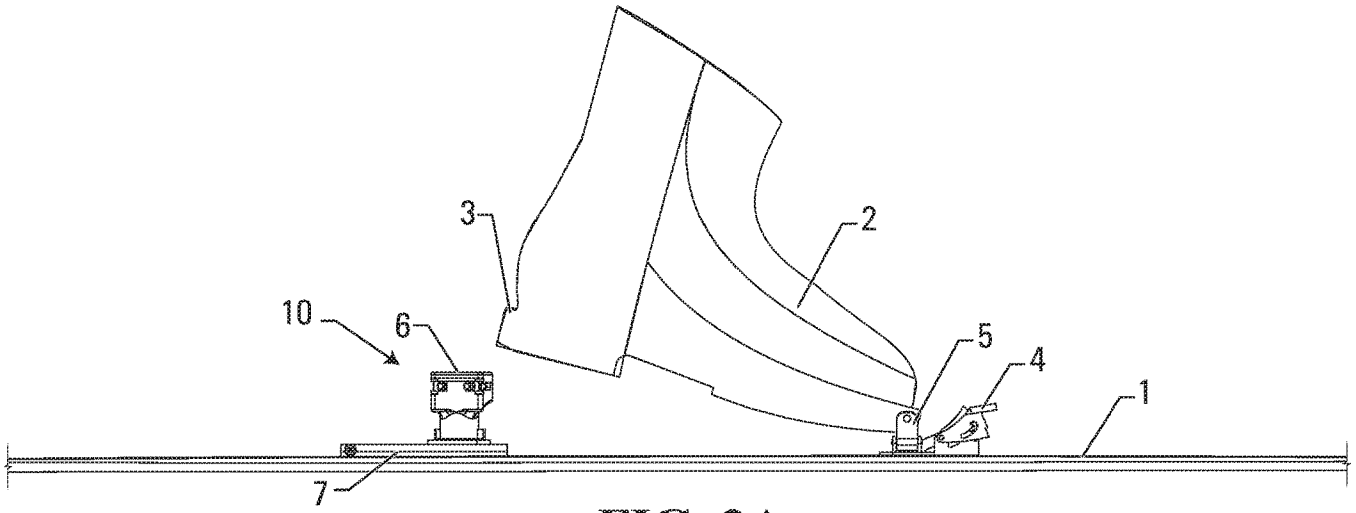
FIG. 2A Prior Art
FIGS. 2A and 2B are side and plan views, respectively showing the combination illustrated in FIGS. 1A and 1B in a touring mode.
Figure 2B:
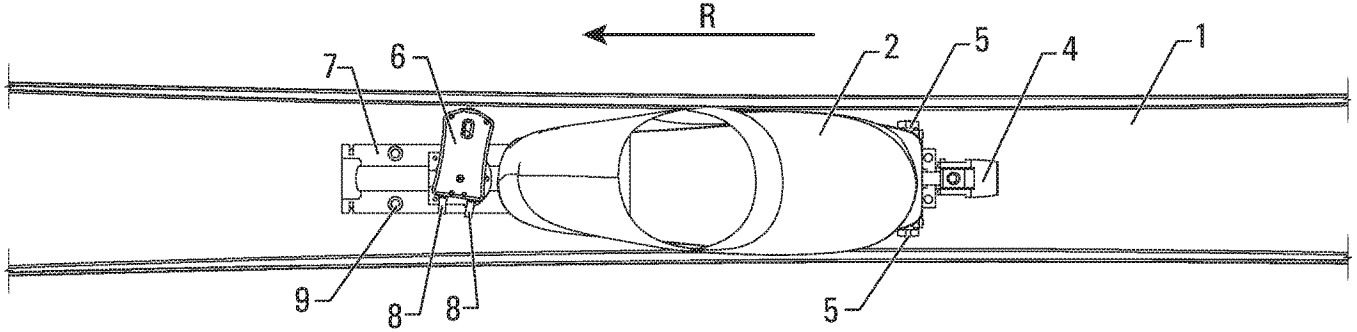
FIG. 2B Prior Art

FIGS. 2A and 2B show the prior art Tech-type system positioned in the touring mode. The toe of the boot remains pivotally engaged to toe unit 4. The heel is free to move up and down relative to the ski because upper portion 6 of the heel unit has been rotated so that pins 8 face away from boot heel 3. In some versions, body 6 can be further rotated (not shown) such that pins 8 face rearward thereby allowing the boot heel 3 to come to rest on an upper surface of upper portion 6. This reduces stress on the user's muscles and tendons while climbing steep hills. In some versions, the body 6 further comprises a heel lift extension (not shown) or foldable heel lifts to permit the user to further elevate the boot heel while climbing steep hills.

In order to switch from the downhill mode shown in FIGS. 1A and 1B to the touring mode shown in FIGS. 2A and 2B, one must free the pins 8 from the boot heel. One method for doing so is for the user to disengage the boot toe from jaws 5 and exit the binding system, prior to switching to the touring mode.

Figure 3:
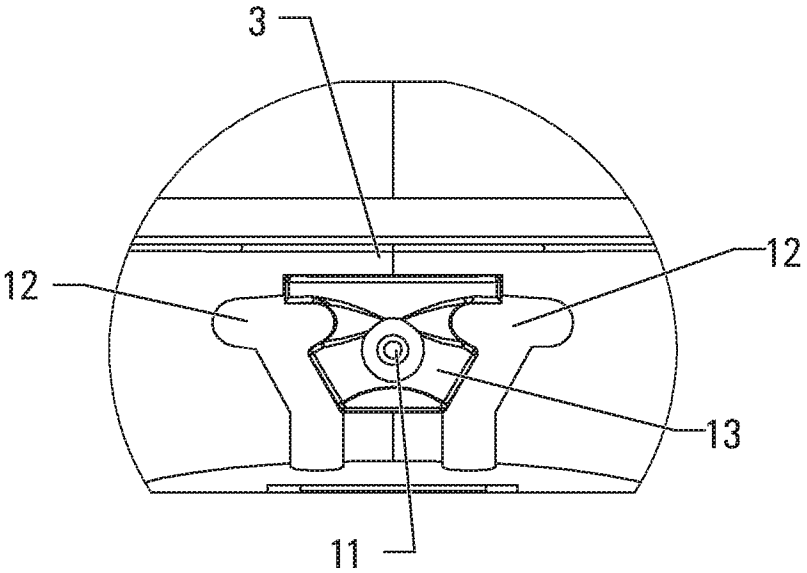
FIG. 3 Prior Art
FIG. 3 is a partial end view of a boot heel containing a prior art fitting for receiving pins of a heel unit of a prior art skin touring binding.

FIG. 3 shows part of the rear end of a boot and the prior art Tech-type boot heel fitting adapted to engage the pins of the prior art heel unit. The upper boot is not shown. Metallic insert 13 is fixed to heel 3 by means of fastener 11. Arcuate cut-away portions 12 on opposite sides of the insert accommodate the pins of the heel unit where the pins engage to hold the boot heel. These arcuate portions are placed over cavities in the boot heel which receive the ends of the pins.

Figure 4:
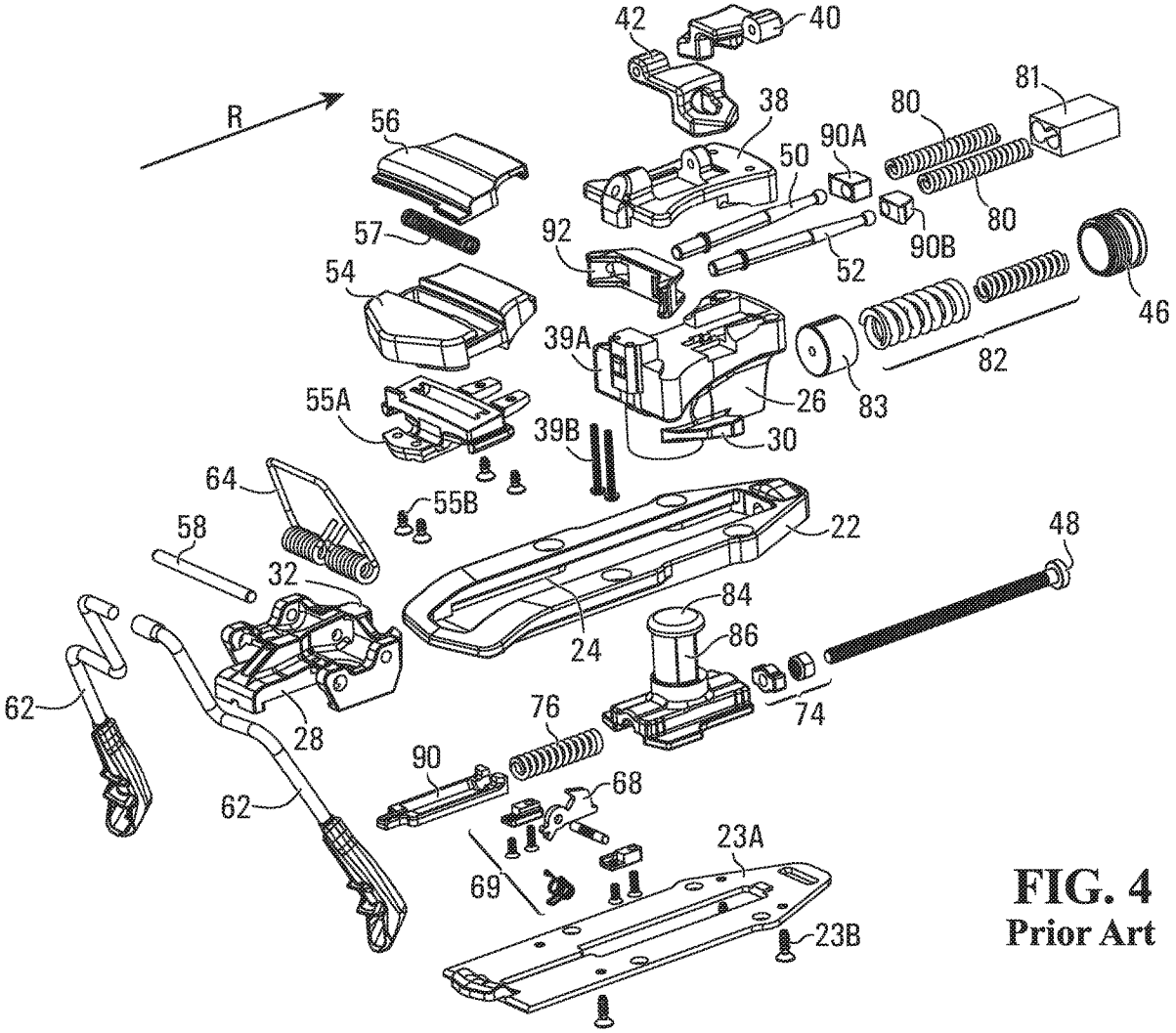
FIG. 4 Prior Art
FIG. 4 is an exploded view of the components of a prior art heel unit as disclosed in U.S. 2015/0014963.

FIG. 4 is an exploded view of a prior art Tech-type heel unit as disclosed in U.S. 2015/001493. Base plate 22 comprises lower plate 23A which is joined to the base plate with appropriate threaded fasteners 23B. Tower 84 is slidably engaged in channel 24 of base plate 22 and is placed within a hollow portion of body 26. Body 26 is retained on tower 84 by engagement of Mz plunger 83 on the tower. Plunger 83 is pressed against the tower by means of Mz spring set 82, the compression pre-load of which is adjusted by the position of cap 46 that is threaded into the body. The rearward end of Mz spring set 82 rests against cap 46 and is thus fixed relative to the body. In this device, the Mz linkage comprises plunger 83 which is configured to be pushed.

Also shown in FIG. 4 is My spring set 80, My spring base 81, pin sleeves 90A and 90B, pins 50 and 52 and release arm 92. When in use, spring set 80 is pre-loaded under compression by adjusting a fixed position of base 81 in the rear of body 26. Spring set 80 urges release arm 92 forward to press against inclined surfaces of sleeves 90A and 90B, thereby urging pins 50 and 52 toward each other to arcuate portions of the inset illustrated in FIG. 3. In this device, the My linkage comprises release arm 92 and sleeves 90A and 90B. This particular arrangement translates longitudinally directed pushing force exerted by spring set 80 into a lateral pushing force that is directed against the sides of pins 50 and 52.

Cover 38 is retained on body 26 in FIG. 4 by being cinched through boss 39A by means of fasteners 39B which extend upward through the boss and engage with appropriate threaded openings in cover 38. Stowable heel lifts 40 and 42 are pivotally attached to cover 38. One end of finger 90 is engaged underneath tower 84 and the finger extends forward to contact hook 68 which is part of brake release components 69. When the binding is in the downhill position, finger 90 is translated forward and contacts the bottom of hook 68 disengaging it from a corresponding portion on spring 64. When body 26 is rotated such that one of lobes 30 contacts boss 32 and the body is translated rearward relative to brake chassis 28 against the biasing force of spring 76, finger 90 moves rearward allowing hook 68 to rotate forwards (assisted by its spring) to be available to engage a corresponding portion on spring 64 when brake pad 54 is depressed, thereby retaining the brake pad in the depressed position with arm 62 raised above the snow, so as to not interfere with touring. Arms 62 are sandwiched between brake pad 54 and lower brake element 55A which is attached to brake pad 54 through appropriate fasteners 55B. Sliding cover 56 is retained in position by spring 57. Axel 58 retains spring 64 in brake chassis 28. Threaded rod 48 cooperates with nut and flange arrangement 74 for positioning tower 84 and the body it supports longitudinally along base plate 22. The cross-sectional view of the assembled prior art heel unit in FIG. 5 shows spring set 80 which is part of the My release system and coaxially arranged spring unit 82 which is part of the Mz release system.

Figure 5:
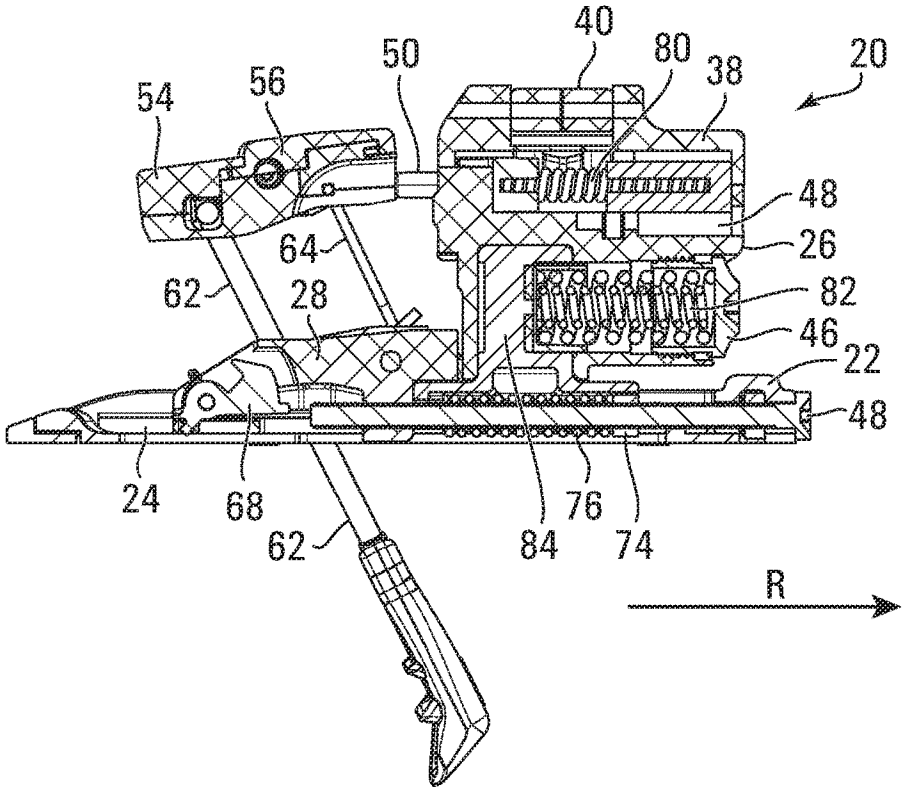
FIG. 5 Prior Art
FIG. 5 is a cross sectional view of the heel unit in FIG. 4 in assembled form.

In the prior art device shown in FIGS. 4 and 5, tower 84 was a spindle shaped post that served as both the support and the axis on which the body rotated. Typically, a plurality of flat zones 86 were arranged around the perimeter of the spindle. Opposing bearing surfaces were also provided on the underside of a cap on one end of the spindle and the upper side of a pedestal at the other end of the spindle. These bearing surfaces cooperate with the side of plunger 83 to retain the upper portion on the tower and guide its rotation on the tower. A distal face of the plunger would abut each of the flat zones in turn, during rotation of the upper portion. Typically, the body would be removed from the heel unit by removal of the plunger from engagement between the bearing surfaces of the tower. When plunger 83 pressed against one of the flat zones on the spindle, the body would be releasably retained at that location.

As will be discussed below, the present invention relates to improvements in a Tech-type heel unit apparatus for holding a footwear heel to a snow travel aid. The apparatus is mountable to the snow travel aid and comprises at least one forward connector for connecting a body of the apparatus to the heel while providing for My release. The body is rotatable on a vertical axis for providing Mz release. The body may also rotate about the vertical axis between a downhill position and at least one touring position. A single resilient element pre-loaded under compression or tension exerts forces along opposing vectors that are transferred by Mz and My systems to simultaneously resist release in the lateral and forward directions. To accomplish this, the resilient element is free to move relative to the body and the Mz and My linkages are independently acted upon at opposing points on the resilient element. The force that resists vertical release is not significantly lessened when the heel unit apparatus is subjected to lateral shocks resulting in some rotational movement of the body about the support. Conversely, the force that resists rotation of the body about the support may also not be significantly lessened when the heel unit apparatus is subjected to vertical shocks that affect the position of the forward connector.

An apparatus employing the present invention may contain components and features of prior art heel units such as in embodiments disclosed in U.S. 2015/0014963 that comprise at least one camming surface positioned such that rotation of the body into the touring mode results in the body translating rearwardly against an opposing force provided by a forward biasing device. Generally, the present invention may also be employed with obvious modification in any Tech-type design in which a body of the heel unit rotates on a vertical axis, including that disclosed in WO2009/105866.

Figure 6:
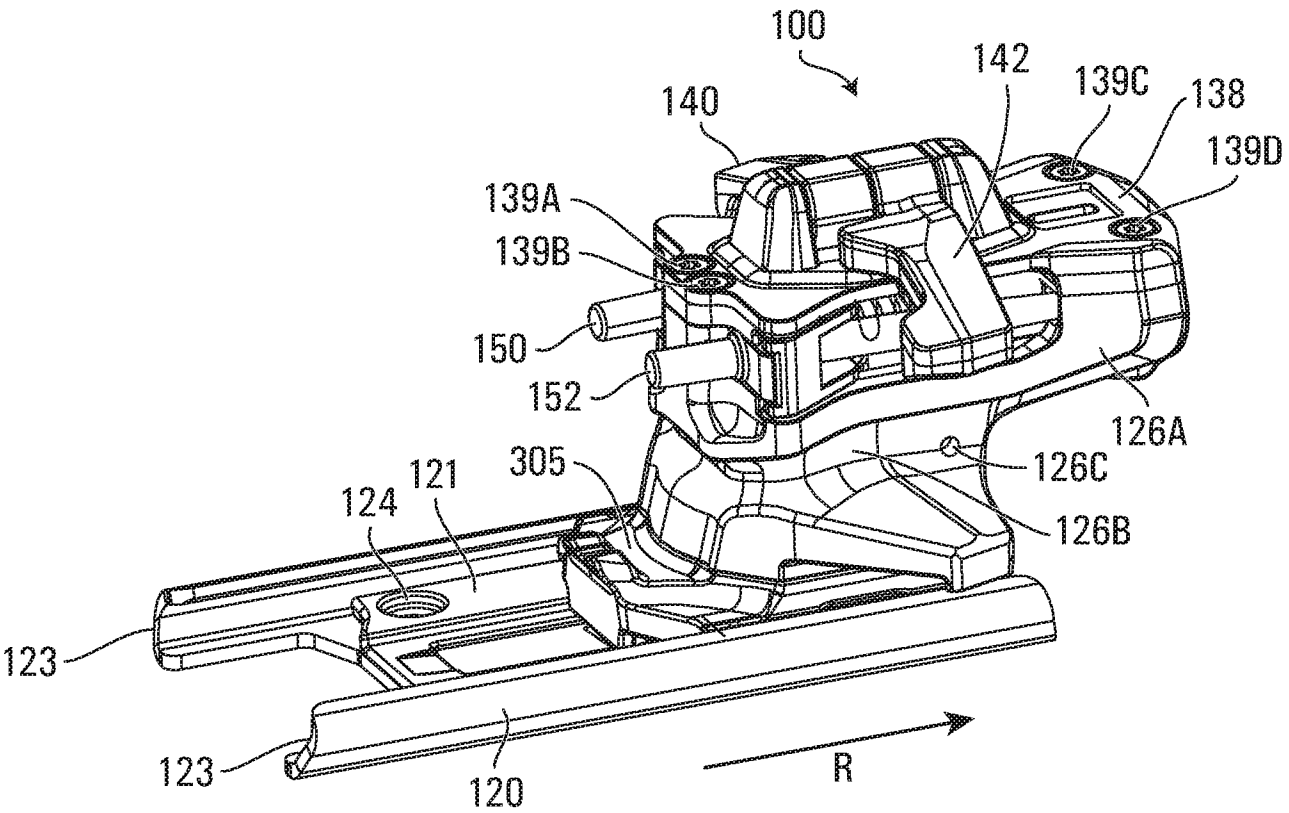
FIG. 6 is a perspective view of a heel unit of this invention without a snow brake.

FIG. 6 illustrates components of a heel unit 100 according to an embodiment of this invention. These components include base 120, base plate 121, support 305, and a body comprising rear half 126A and forward half 126B which are held together by through-pin 126C. Cover 138 is held to the rearward and forward halves of the body by threaded fasteners 139A-139D. Cover 138 further comprises stowable heel lifts 140 and 142. Pins 150 and 152 extend forwardly from the body and rearwardly internal to the body. The pins are configured to engage with the arcuate portion 12 of a typical Tech-type fitting in a footwear heel such as is illustrated in FIG. 3. Support 305 is slidably engaged in longitudinal channels 123 of base 120. The base comprises a plurality of openings of which one is illustrated as opening 124 for receiving typical fasteners used to attach heel unit 100 to the top surface of a snow travel aid.

Figure 7:
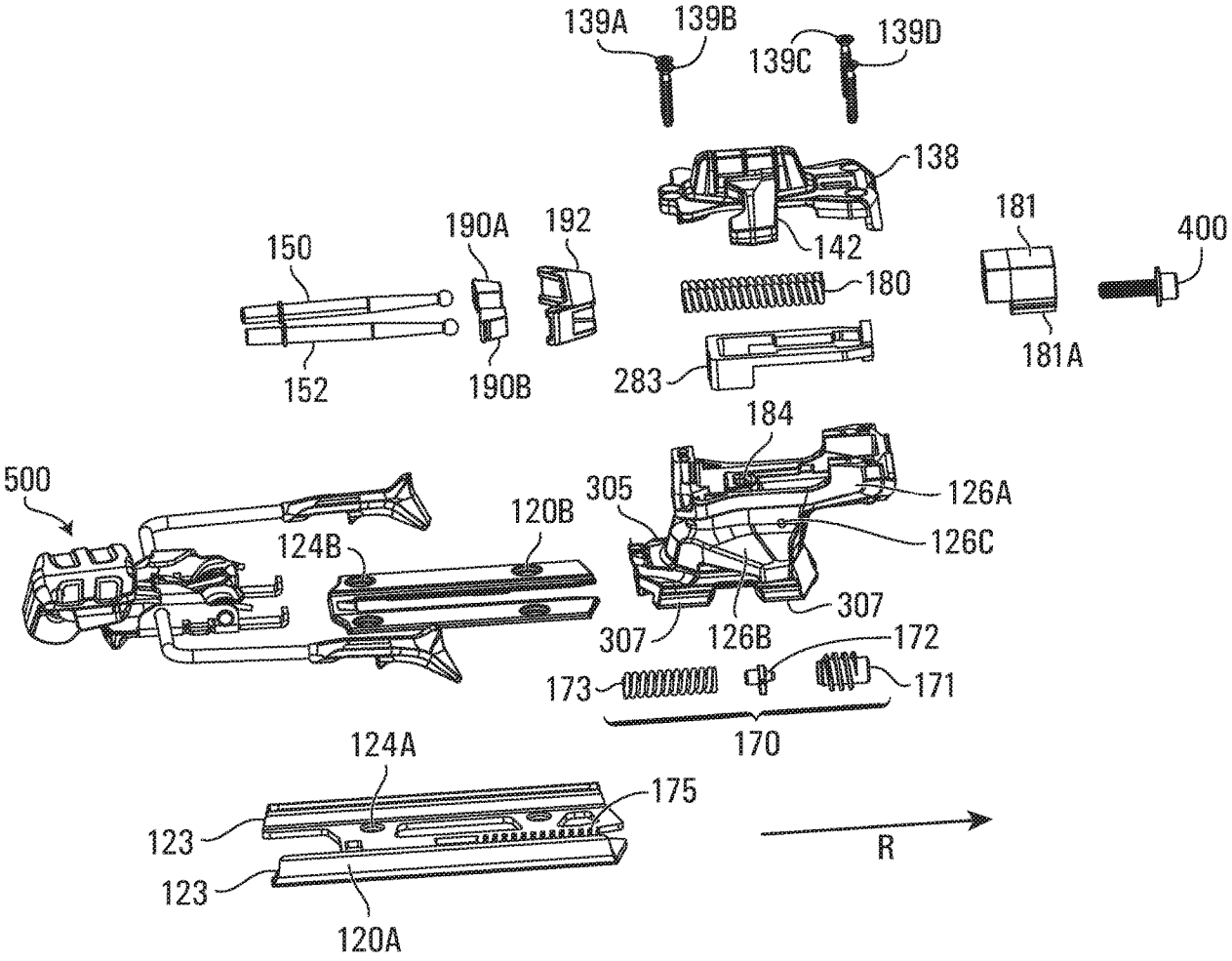
FIG. 7 is an exploded view of the components of the heel unit shown in FIG. 6 with a snow brake.

FIG. 7 shows components of heel unit 100 in exploded arrangement. The exploded view shows that the base comprises lower portion 120A and upper portion 120B, each containing matching through holes 124A and 124B, respectively. Included in this illustration is a view of a snow brake which is also configured to engage with channels 123 in the base. At the bottom of support 305 are flanges 307 which slidably engage with channels 123. Support 305 also comprises adjustor components 170 which include threaded adjustor 171 that rotates against flange 172 engaged with spring 173. Threaded adjustor 171 cooperates with track 175 longitudinally arranged along lower base portion 120A. Pins 150 and 152 pass through pin sleeves 190A and 190B which cooperate in a sliding wedge arrangement with matching inclined surfaces within the forward side of release arm 192 as was the case for the My linkage in the prior art. The springs of spring set 180 insert into appropriate openings in the rear of release arm 192 and openings in the front of spring base 181. Spring base 181 comprises a lower portion 181A containing a rearward directed opening for receiving threaded release adjustor 400. The sides of lower portion 181A are configured to slidably engage within bracket 283 which lies under spring set 180. Release arm 192 is movable so that it will be urged forward by the spring set to press against pin sleeves 190A and 190B to urge pins 150 and 152 toward each other. Unlike the prior art, spring base 181 is not at a fixed position but is movable within the body so that force can be transferred through it to and from the remainder of the Mz release linkage which includes bracket 283 described below.

Figure 8:
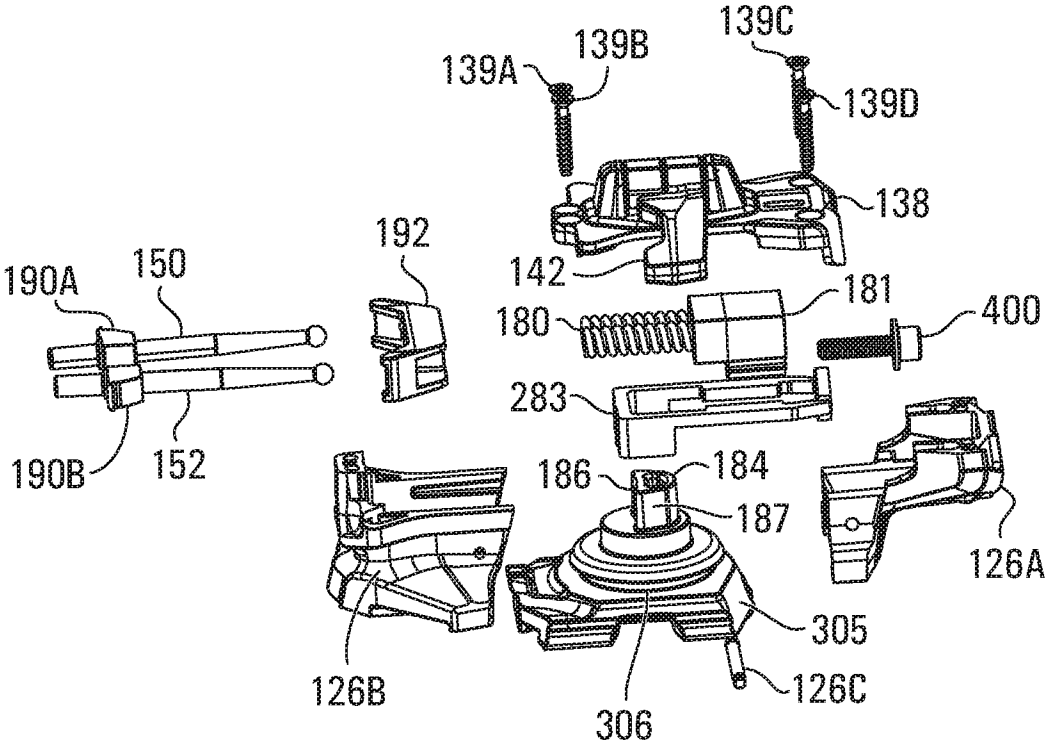
FIG. 8 is a partial exploded view of some of the components shown in FIG. 7 in which the body of the heel unit is separated into forward and rearward halves.

The exploded view in FIG. 8 further illustrates the arrangement of body halves 126A and 126B with support 305. Forward and rearward halves 126B and 126A can be separated by removing through-pin 126C. Together, the forward and rearward halves rest on tower support 305 and enclose tower 184 in a turret-like fashion whereby body 126 is rotatably engaged with support 305 and retained there by engagement near the bottom of halves 126A and 126B with circular groove 306 in base 305. Tower 184 comprises forward region 186 on its perimeter that acts as a rest for bracket 283 when this heel unit is in the downhill mode. Also shown is rest 187 on a lateral region of the perimeter of tower 184 which serves as a resting surface for bracket 283 in a touring mode.

Figure 9:
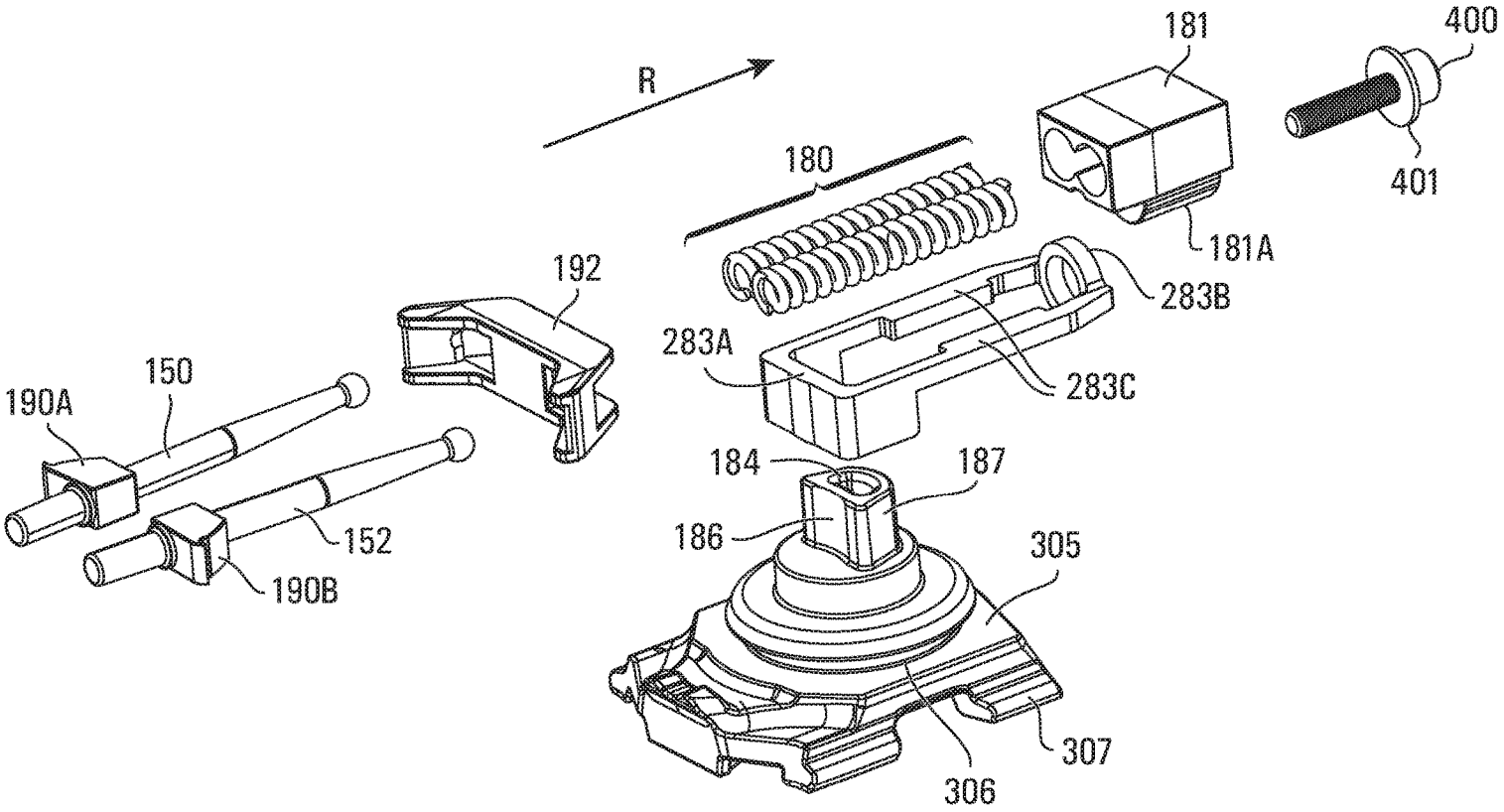
FIG. 9 is an oblique, exploded view of some of the components shown in FIG. 8 enlarged for detail.

The exploded view in FIG. 9 better illustrates cooperation of components of the Mz linkage that transfers force between the rearward end of spring set 180 and support 305. The bracket comprises forward region 283A, the inner part of which is a bearing surface that will bear on the perimeter of tower 184 and will rest against resting surfaces 186 and 187. Forward region 283A of the bracket is connected by a pair of arms 283C to rear bearing area 283B. Longitudinal grooves in lower part 181A of spring base 181 slidably engage with flange regions on arms 283C. Threaded adjustor 400 is engaged within the threaded opening at the rear of lower portion 181A so that flange 401 is situated between a rearward surface of spring base 81 and a forward surface of rear bearing area 283B. The head of adjustor 400 may be accessed through a corresponding opening in rear half of 126A of the body. Adjustor 400 is not fixed to the body but instead connects spring base 181 to bracket 283 and is also used to adjust the location of spring base 181 relative to bracket 283 to achieve a particular compression pre-load in spring set 180 which simultaneously provides desired release values for both forward and lateral release. Thus, spring set 180 is a single resilient means employed for both the My and Mz systems. An appropriate ratio between the amounts of force that resist My and Mz release can be achieved through selecting appropriate geometry and dimensions of My and Mz components for assembly into the apparatus.

When spring set 180 is pre-loaded under compression, it exerts force that presses against release arm 192 that pushes against pin sleeves 190A and 190B which translate that force in opposing transverse directions so that pins 150 and 152 are urged towards each other laterally at their forward ends, to the resting position. The release arm 192 and the pin sleeves constitute the Mz linkage between the resilient element (spring set 80) and the forward connection for releasably connecting the foot heel to the heel unit. When pins 150 and 152 are forced apart by upward movement of the footwear heel, sleeves 190A and 190B move rearward and increase compression on spring set 180 through release arm 192.

At all times when spring set 180 of the illustrated embodiment is pre-loaded under compression, it also bears against spring base 181 which is urged rearwardly and is movable within the body. This force is converted to a pulling action by cooperation of spring base 181 with bracket 283 through adjustor 400 so that the bearing surface of forward region 283A of the bracket is pressed against the perimeter of tower 184 to resist rotation of the body relative to support 305. Spring base 181, adjustor 400 and bracket 283 are each part of the Mz linkage between the resilient element and a resting surface on the heel unit support to resist rotation of the body about the support. This arrangement simplifies the heel unit design and minimizes weight through the use of a single resilient element to provide the force to resist My and Mz release. Further, since the Mz and My linkages are acted upon by opposing ends of spring set 180, rotational movement of the body relative to the support 305 will not significantly decrease the force that is exerted through the My linkage. Conversely, movement of pins 150 and 152 from the resting towards the release position will not result in a significant decrease in the force exerted through the Mz linkage.

Figure 10:
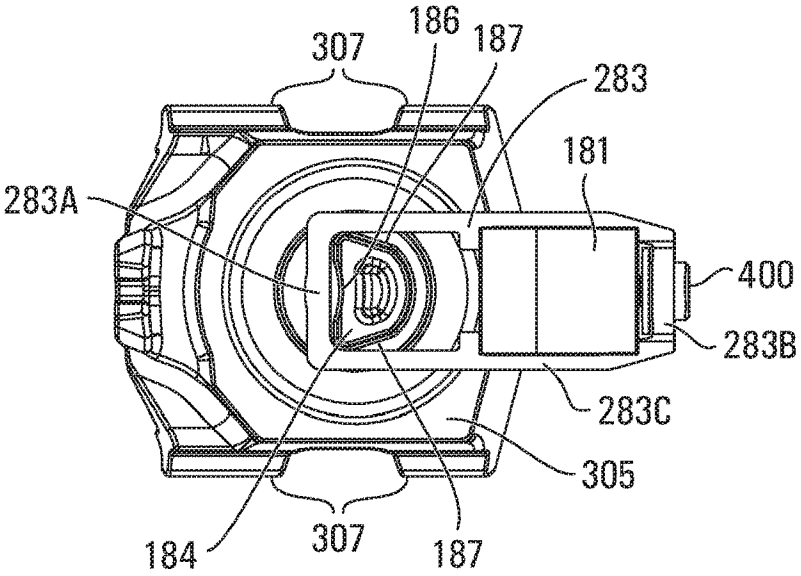
FIG. 10 is a top view of some of the components shown in FIG. 9 in assembled form.

The view in FIG. 10 illustrates the arrangement of bracket 283 and spring base 181 relative to tower 184 in the downhill mode. In this drawing, the bearing surface of forward region 283A of bracket 283 bears on forward region 186 on the perimeter of tower 184.

Figure 11:
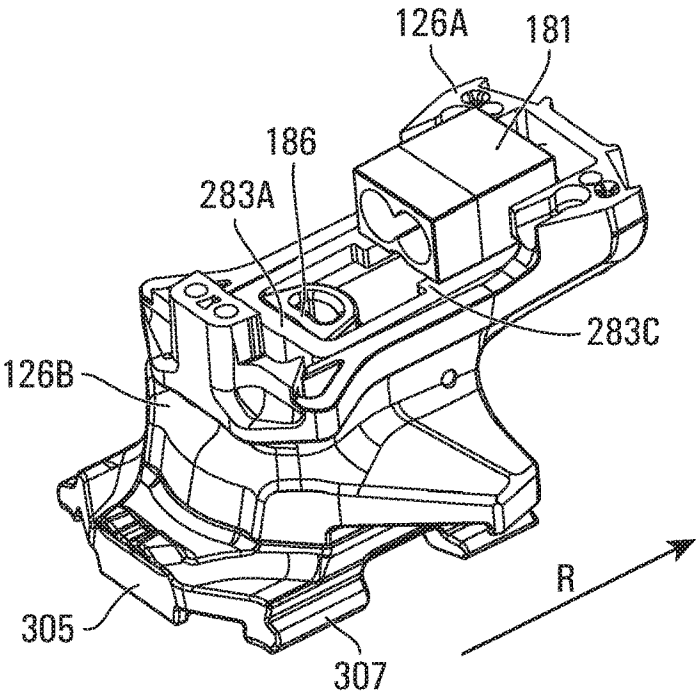
FIG. 11 is a perspective view of some of the components shown in FIG. 8, in assembled form.

FIG. 11 helps to illustrate the cooperation of components shown in FIG. 9 in assembled form. In FIG. 11, the components have been assembled without including spring set 180 and the My components.

Figure 12:
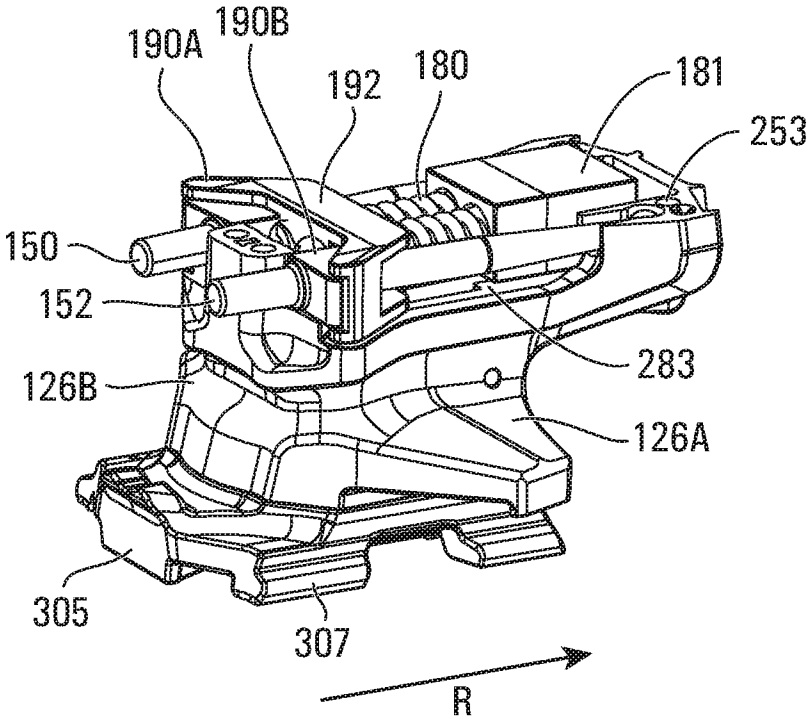
FIG. 12 is a perspective view of additional components shown in FIG. 8, in assembled form.

FIG. 12 shows the components illustrated in FIG. 11 with spring set 180, release arm 192, pin sleeves 190A and 190B, and pins 150 and 152 in place. This drawing illustrates how rearward portions of pins 150 and 152 within cavities 153 in rear half 126A of the body, which cavities act as a rotational base for the pins that hold the pins in place.

Figure 13:
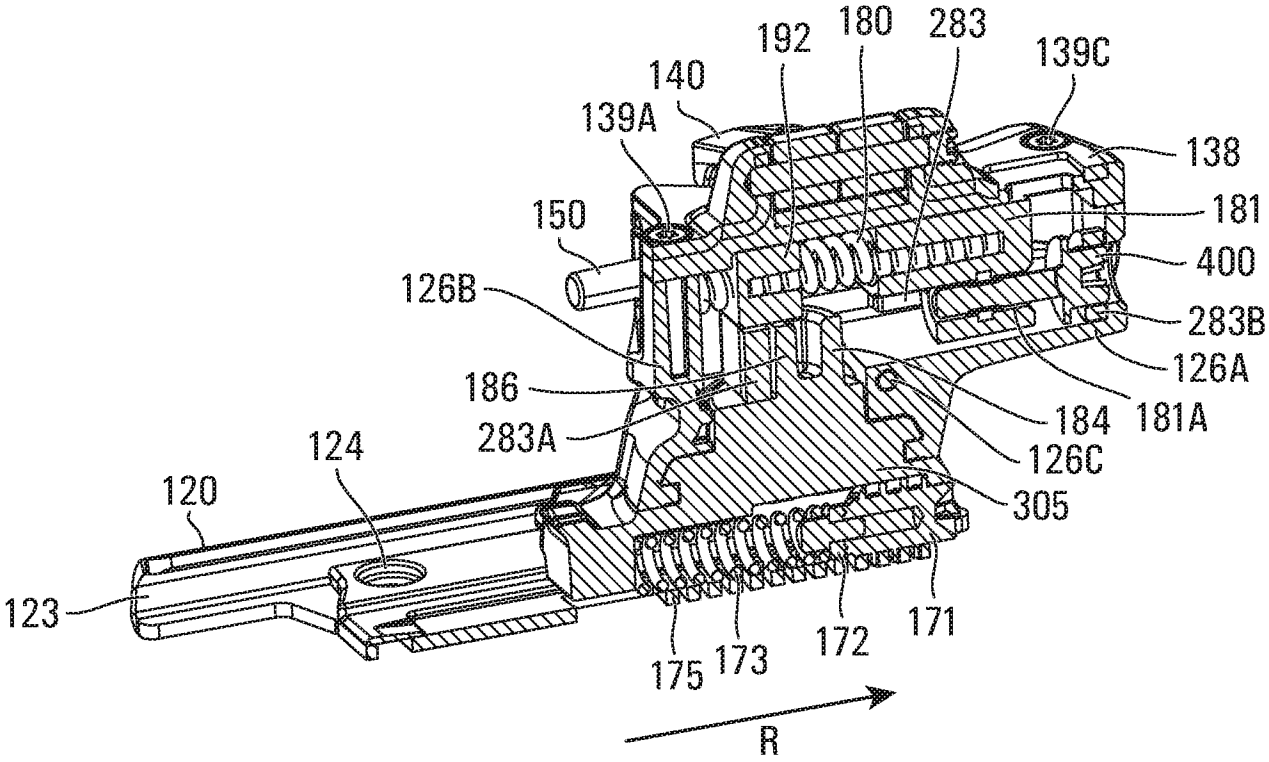
FIG. 13 is a perspective view of a longitudinal section of the heel unit illustrated in FIG. 6.
Figure 14:
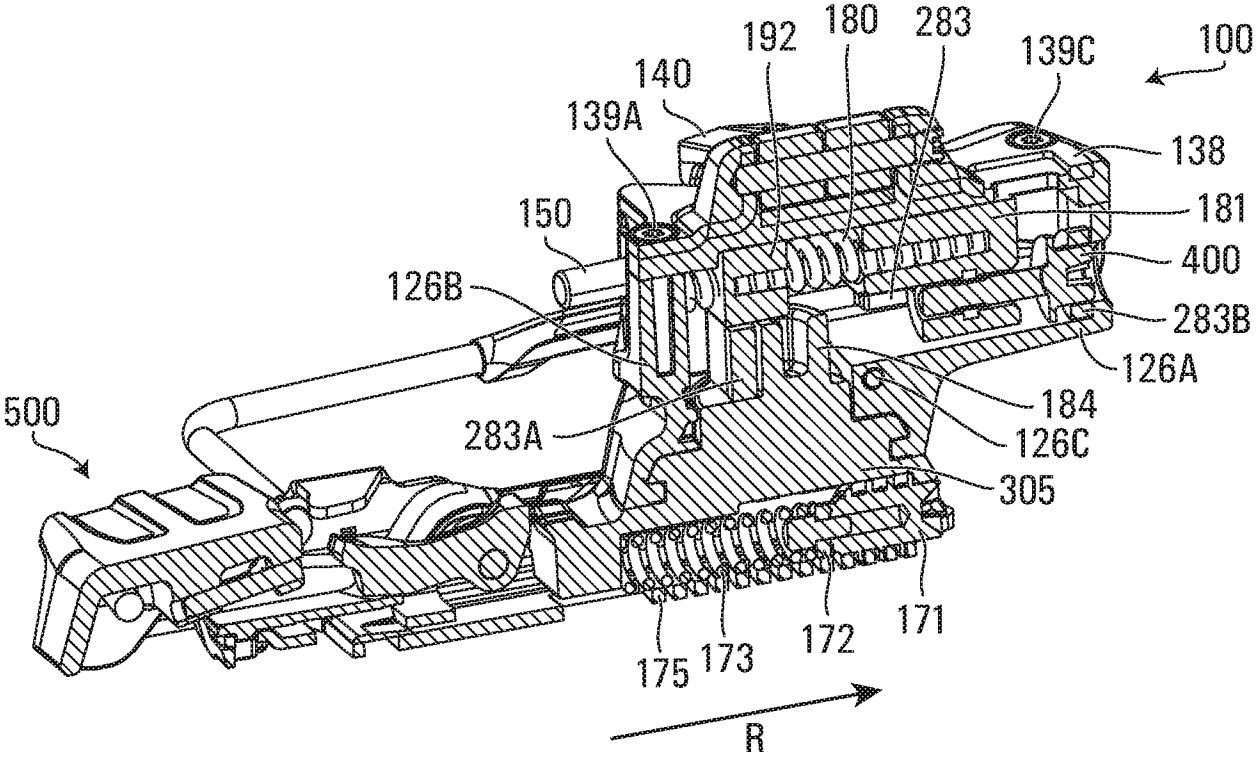
FIG. 14 is a perspective view of a longitudinal section of the heel unit illustrated in FIG. 6, including the snow brake illustrated in FIG. 7.

The sectional view shown in FIG. 13 illustrates cooperation of the various components of the illustrated heel unit of this invention in assembled form. Similarly, the sectional view in FIG. 14 shows those components as well as the location of snow brake 500 that is illustrated in FIG. 7.

Although the invention has been described in some detail by way of illustration and example for purposes of clarity of understanding, it will be readily apparent to those of skill in the art in light of the teachings of this specification that changes and modification may be made thereto without departing from the spirit and scope of the invention as recited in the appended claims. All patents, patent applications and other publications referred to herein are hereby incorporated by reference.

The invention claimed is:

1. A heel unit apparatus for a ski touring binding, the apparatus comprising a body mounted on a support, wherein the body is rotatable relative to the support on a vertical axis, characterized in that the body comprises:

a resilient element movable within the body and which when pre-loaded under compression or tension, exerts forces in opposing directions;

at least one forward connector moveable between resting and release positions for releasably connecting the body to the heel of a footwear;

a My linkage between the resilient element and the at least one forward connector configured such that a force exerted by the resilient element in one of the opposing directions resists movement of the at least one forward connector from the resting position to the release position; and a Mz linkage between the resilient element and a resting surface on the support configured such that a force exerted by the resilient element in an opposite one of the opposing directions presses against the resting surface to resist rotation of the body about the support.

2. The apparatus of claim 1, wherein the My linkage and the Mz linkage are acted upon independently by the resilient element, at opposing points on the resilient element.

3. The apparatus of claim 1, wherein one of the linkages is configured to push and the other to pull.

4. The apparatus of claim 1, wherein the My linkage is configured to push and the Mz linkage is configured to convert pushing force to pulling force.

5. The apparatus of claim 1, wherein the My linkage changes direction of force exerted by the resilient element from a longitudinal to a transverse direction.

6. The apparatus of claim 1, wherein the at least one forward connector is a pair of pins and the movement between the resting and release positions is a convergence or separation of the pins.

7. The apparatus of claim 1, wherein the at least one forward connector is a pair of pins, the movement between the resting and release positions is a separation of the pins and the My linkage presses against the pins to resist said movement.

8. The apparatus of claim 1, wherein the resilient element is a spring or a spring set.

9. The apparatus of claim 1, wherein the resilient element is pre-loaded under tension.

10. The apparatus of claim 1, wherein the resilient element is pre-loaded under compression.

11. The apparatus of claim 1, wherein at least one of the My and Mz linkages comprises a bracket.

12. The apparatus of claim 1, wherein the support comprises a tower about which the body rotates, wherein the tower is shaped at one or more locations about its perimeter to provide one or more resting surfaces on which the Mz linkage bears during rotation of the body.

13. The apparatus of claim 12, wherein the Mz linkage comprises a bracket comprising a rearward end connected to a rearward end of the resilient element, the bracket further comprising a forward end comprising a rearward facing bearing surface that bears on the tower perimeter during rotation of the body.

14. The apparatus of claim 1, wherein the amount of resistance to movement of the at least one forward connector from the resting position to the release position and the amount of resistance to rotation of the body about the support are simultaneously altered by changing an amount of compression or tension under which the resilient element is pre-loaded.

15. The apparatus of claim 14, comprising an adjustor for changing said amount.

16. The apparatus of claim 14, wherein the resilient element is a spring or spring set pre-loaded under compression and the apparatus further comprises an adjustor for altering the amount of compression under which the spring or spring set is pre-loaded.

17. The apparatus of claim 16, wherein the adjustor is part of the Mz linkage.

18. The apparatus of claim 1, further comprising a base mountable to a snow travel aid for holding the support.

19. The apparatus of claim 18, wherein the support and base are configured for slidable engagement and the base further comprises an adjustor for positioning the support along a longitudinal direction on the base.

20. The apparatus of claim 1, further comprising a snow brake.

* * * * *